US012722072B1

(12) United States Patent
Liang

(10) Patent No.: US 12,722,072 B1
(45) Date of Patent: Sep. 1, 2026

(54) SHUFFLING MACHINE

(71) Applicant: WEIXING CHUANGKE (SHENZHEN) TECHNOLOGY CO., LTD., Shenzhen City (CN)

(72) Inventor: Yaowen Liang, Shenzhen City (CN)

(73) Assignee: WEIXING CHUANGKE (SHENZHEN) TECHNOLOGY CO., LTD., Shenzhen City (CN)

( * ) Notice: Subject to any disclaimer, the term of this patent is extended or adjusted under 35 U.S.C. 154(b) by 0 days.

(21) Appl. No.: 19/530,273

(22) Filed: Feb. 4, 2026

(30) Foreign Application Priority Data

Dec. 26, 2025 (CN) ..... 202522769047.0

(51) Int. Cl.
*A63F 1/12* (2006.01)

(52) U.S. Cl.
CPC ..... *A63F 1/12* (2013.01)

(58) Field of Classification Search
CPC ..... A63F 1/10; A63F 1/12; A63F 1/14
USPC ..... 273/149 R
See application file for complete search history.

(56) References Cited

U.S. PATENT DOCUMENTS 1,846,063 A * 2/1932 Matthaey ..... A63F 1/12 273/149 R

FOREIGN PATENT DOCUMENTS

CN 220257131 U * 12/2023
CN 220443166 U * 2/2024
CN 222693969 U * 4/2025
CN 223586534 U * 11/2025
IT RM20120621 A1 * 6/2014 ..... A63F 1/12

OTHER PUBLICATIONS

ITRM20120621 Translated spec (Year: 2014).*
CN-220257131 Translation (Year: 2023).*
CN-220443166 Translation (Year: 2024).*
CN-222693969 Translation (Year: 2025).*
CN-223586534 Translation (Year: 2025).*
ITRM20120621 Partial Translation (Year: 2014).*

* cited by examiner

*Primary Examiner* — Brian P Wolcott
(74) *Attorney, Agent, or Firm* — Li & Cai Intellectual Property Office

(57) ABSTRACT

A shuffling machine includes a machine body and a first card supporting bracket. The machine body is provided with a card chamber receiving cards from at least two card supply devices on the machine body. The card chamber is provided with a card passing hole passing through a bottom of the card chamber. The first card supporting bracket is disposed at the card passing hole. The first card supporting bracket is provided with a first connecting portion parallel to a card supporting surface of the first card supporting bracket. The machine body is rotatably connected to the first connecting portion and is rotatable around the first connecting portion.

10 Claims, 7 Drawing Sheets

SHUFFLING MACHINE

FIELD OF THE DISCLOSURE

The present disclosure relates to card game equipment, and particularly relates to a shuffling machine.

BACKGROUND OF THE DISCLOSURE

Shuffling is an important task in card games. Compared with manual shuffling, use of a shuffling machine saves time and also reduces cheating during shuffling, thereby providing a broad market prospect for a shuffling machine.

An existing shuffling machine is provided with a card chamber in a machine body, and at least two card supply devices are provided on the machine body. The card chamber is located downstream of the card supply devices. A card taking opening is provided at a side portion of the machine body. During shuffling, cards are separately placed in the at least two card supply devices, the at least two card supply devices simultaneously operate to feed cards into the card chamber to realize shuffling. After shuffling is completed, a user stretches out a hand into the card chamber from the card taking opening to take out a card stack. During a process of stretching out the hand into the card chamber to take out the card stack, the hand is prone to contact the machine body, namely, card taking is prone to being interfered with by the machine body.

SUMMARY OF THE DISCLOSURE

An objective of the present disclosure is to provide a shuffling machine, and the shuffling machine has characteristics of card taking without interference by a machine body, and is simple and convenient operation and has high efficiency.

To achieve the above objective, a technical solution adopted by the present disclosure is as follows.

A shuffling machine includes a machine body and a first card supporting bracket. The machine body is provided with a card chamber receiving cards from at least two card supply devices on the machine body. The card chamber is provided with a card passing hole penetrating a bottom of the card chamber. The first card supporting bracket is disposed at the card passing hole. The first card supporting bracket is provided with at least one first connecting portion parallel to a card supporting surface of the first card supporting bracket, and the machine body is rotatably connected to the first connecting portion and is rotatable around the first connecting portion.

In the above solution, after the cards enter the card chamber, the cards fall onto the first card supporting bracket. After shuffling is completed, the cards are stacked on the first card supporting bracket to form a new card stack. By turning the machine body by a predetermined angle around the first connecting portion, the card chamber leaves surroundings of the card stack, thereby enabling the card stack to be taken away from the first card supporting bracket without interference by the machine body. After the card stack is taken away, reverse turning of the machine body completes resetting of the machine body, thereby enabling entry into a next shuffling operation. The above solution not only avoids interference by the machine body when taking away the card stack, but also enables single-hand operation for turning the machine body and grasping the card stack, and the operation is simple and convenient. A user can turn the machine body with one hand while grasping the card stack with another hand, using two hands to improve card taking efficiency.

The machine body includes a shuffling state and a card taking state after shuffling is completed.

Further, the machine body has a first support surface cooperating with a tabletop to support the machine body in the card taking state. The first connecting portion is arranged at a first edge of the first card supporting bracket, the first edge is parallel to the first support surface and is closest to the first support surface. The first connecting portion is spaced apart from the first support surface by a preset distance.

In the above further solution, the first connecting portion is spaced apart from the first support surface by the preset distance. When the machine body is pushed to rotate by the predetermined angle around the first connecting portion to enable the machine body to enter a state in which the first support surface cooperates with the tabletop to support the machine body, the first edge of the first card supporting bracket is lifted upward, and a gap is formed between a card stack on the first card supporting bracket and the tabletop. Fingers of the user are insertable into the gap from two opposite side surfaces of the card stack, and the card stack is graspable from a side portion and a bottom portion of the card stack.

Preferably, the preset distance is not less than 10 millimeters and is not greater than 50 millimeters.

Further, the first card supporting bracket has a second edge opposite to the first edge, and the second edge is provided with a card blocking portion extending upward relative to the card supporting surface of the first card supporting bracket.

In the above further solution, the card blocking portion provides a blocking effect on cards from the side portion of the card stack, thereby enabling the gap to be formed between the card stack on the first card supporting bracket and the tabletop, while also avoiding cards sliding off the first card supporting bracket onto the tabletop.

Further, a side portion of the card chamber opposite to the first support surface is provided with a clearance hole communicating with the card passing hole.

In the above further solution, the clearance hole is provided, and during a process of pushing the machine body to rotate around the first connecting portion, the machine body is not prone to contact the card stack.

Further, in the shuffling state, the card blocking portion extends to the side portion of the card chamber, and partially closes or completely closes the clearance hole.

In the above further solution, the card blocking portion also constitutes a hole cover of the clearance hole, and separate provision of a hole cover for the clearance hole is unnecessary, thereby simplifying a product structure.

Preferably, the first card supporting bracket is an L-shaped plate body.

In the above preferred solution, the L-shaped plate body is adopted for the first card supporting bracket, thereby having a characteristic of convenient manufacturing.

Further, the machine body has a second support surface cooperating with the tabletop to support the machine body in the shuffling state, and a connecting portion between the second support surface and the first support surface is provided with an arc-shaped guide surface cooperating with the tabletop to guide rotation of the machine body.

In the above further solution, the connecting portion between the second support surface and the first support surface of the machine body is provided with the arc-shaped guide surface. During a process of pushing the machine body to rotate around the connecting portion, the arc-shaped guide surface cooperates with the tabletop to guide rotation of the machine body, thereby making turning of the machine body more stable.

Further, two ends of the first edge of the first card supporting bracket are respectively provided with elastic lugs extending away from the first card supporting bracket, and the first connecting portion is arranged at the elastic lug.

In the above further solution, the first connecting portion is connected to the elastic lug, thereby enabling deformation of the first connecting portion and enabling use of the deformation of the first connecting portion to realize rotatable connection with the machine body, and the first connecting portion is enabled to adopt an integrated structure with the first card supporting bracket.

Further, the elastic lugs and the first connecting portions are integrally formed with the first card supporting bracket.

DETAILED DESCRIPTION OF THE EXEMPLARY EMBODIMENTS

The present disclosure is further described below in conjunction with the drawings and embodiments.

The present disclosure relates to a shuffling machine as follows. The shuffling machine includes a machine body. The machine body is provided with at least two card supply devices, a card chamber is disposed in the machine body, the card chamber is located downstream of the card supply devices, and cards from different card supply devices enter the card chamber and fall. The cards are stacked in the card chamber to form a new card stack, and a purpose of shuffling is achieved.

The present disclosure, through improvement of a card chamber structure, enables an operation of taking away the card stack from the card chamber after shuffling is completed to be free from interference by the machine body, and operation is simple and convenient and efficiency is high.

Figure 1:
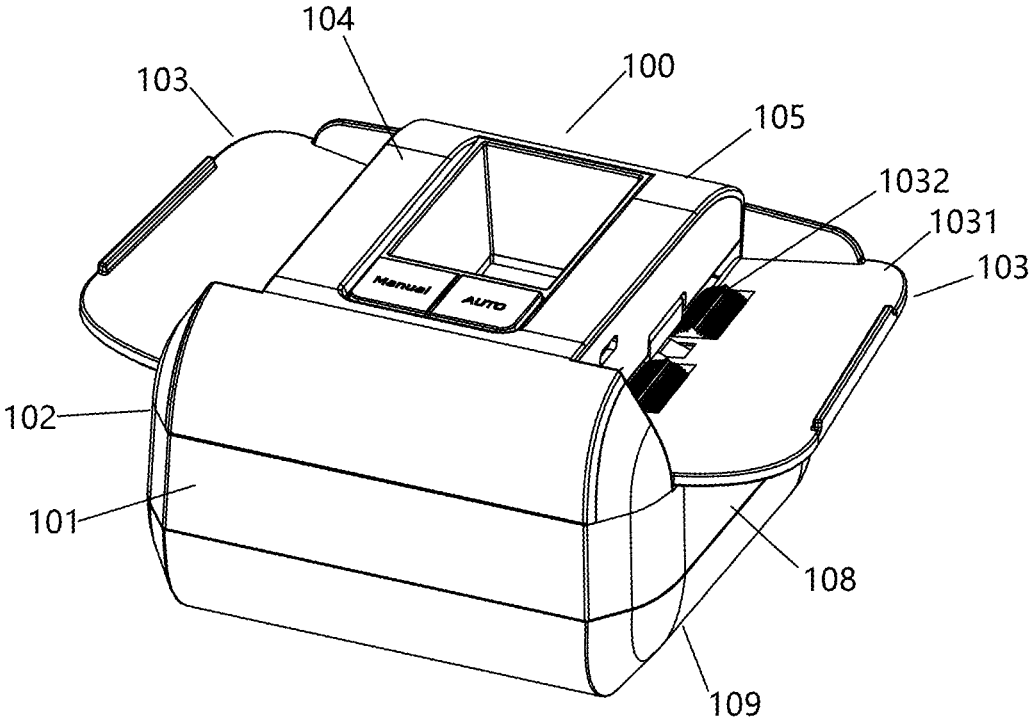
FIG. 1 is a schematic structural view of a shuffling machine of an embodiment.

Referring to FIG. 1, in the present embodiment, a machine body 100 of the shuffling machine has a front side surface 101, a left side surface 102, a top surface 104, a rear side surface 105, a right side surface 108, and a bottom surface 109, and has two card supply devices 103. The two card supply devices 103 are disposed at the left side surface 102 and the right side surface 108 of the machine body 100.

Each card supply device 103 includes a card supporting bracket. For ease of distinction, the card supporting bracket is referred to below as a second card supporting bracket 1031. The second card supporting bracket 1031 is provided with a card rubbing roller 1032. The card rubbing roller 1032 is transmission-connected to a shuffling motor. During shuffling, the shuffling motor drives the card rubbing roller 1032 to rotate, the card rubbing roller 1032 drives a bottommost card of a card stack on the second card supporting bracket 1031 to move, and a card enters a card chamber 110 (referring to FIG. 2) from a card entry opening on the machine body 100.

It should be noted that positions of the two card supply devices 103 on the machine body 100 are not limited to positions shown in the present embodiment. For example, the two card supply devices 103 can be also disposed at two adjacent side surfaces of the machine body 100, and the two card supply devices 103 can be also disposed at a same side surface of the machine body 100 and distributed with an up-down spacing. In addition, a quantity of the card supply devices 103 can be also greater than two.

Figure 2:
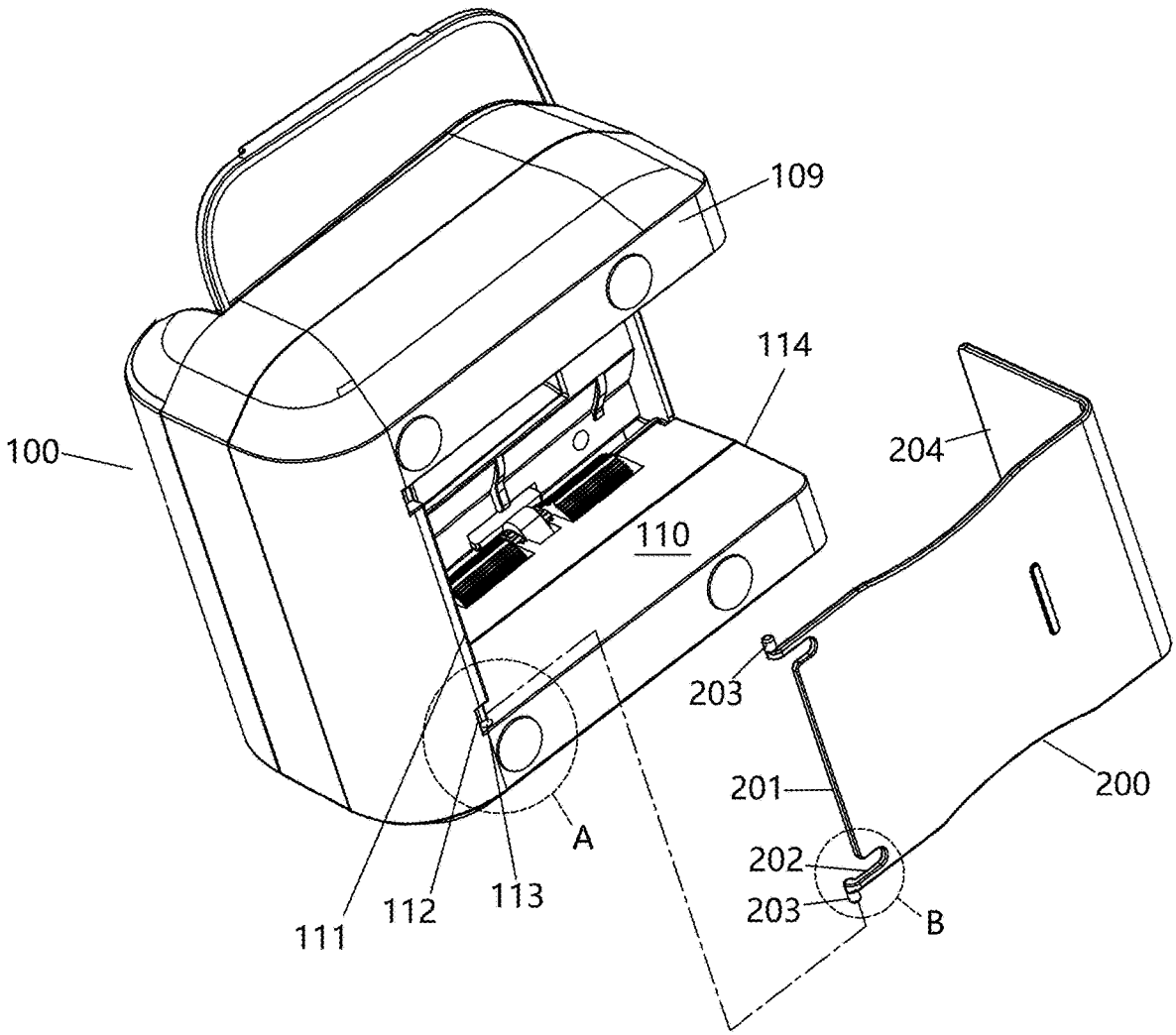
FIG. 2 is a schematic view after disassembly of a first card supporting bracket and a machine body.
Figure 3:
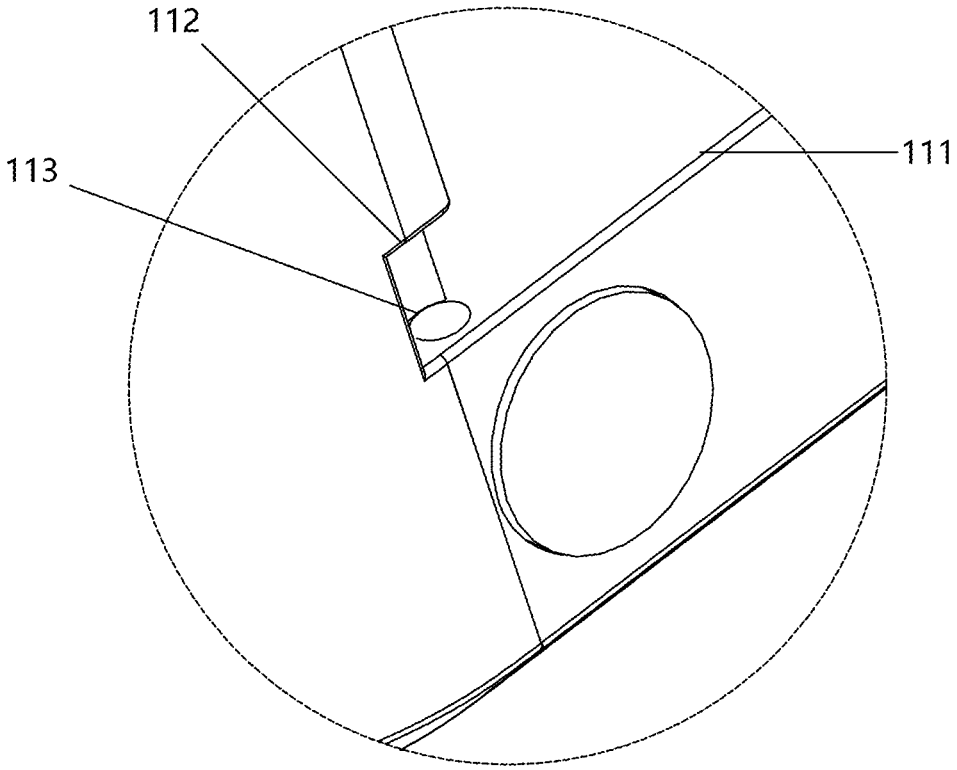
FIG. 3 is an enlarged view of portion A in FIG. 2.
Figure 4:
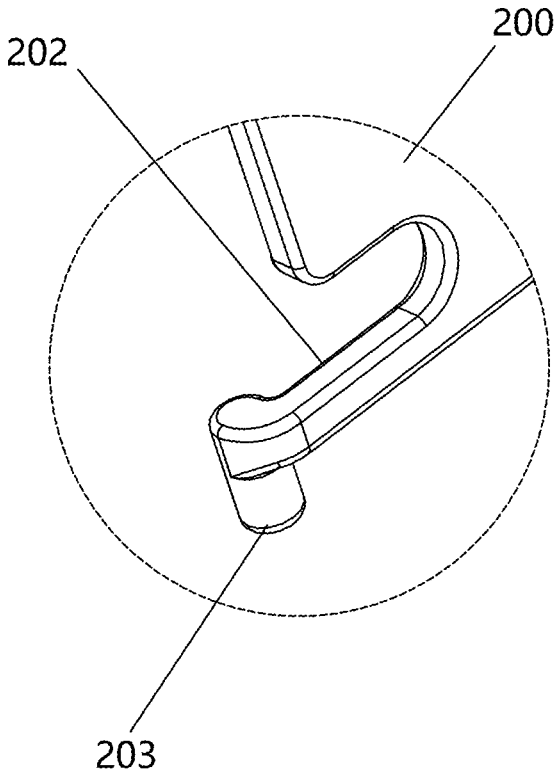
FIG. 4 is an enlarged view of portion B in FIG. 2.

In conjunction with FIG. 1 to FIG. 5, improvement of the card chamber structure includes the card chamber 110 provided with a card passing hole 111 passing through a bottom of the card chamber 110, and includes addition of a first card supporting bracket 200. The first card supporting bracket 200 is disposed at the card passing hole 111. The first card supporting bracket 200 is provided with at least one first connecting portion 203 parallel to a card supporting surface of the first card supporting bracket 200. The machine body 100 is rotatably connected to the first connecting portion 203 and is rotatable around the first connecting portion 203. As shown in FIG. 2, a surface of the first card supporting bracket 200 facing toward the card chamber 110 is the card supporting surface.

Through the above improvement, after the cards enter the card chamber 110, the cards fall onto the first card supporting bracket 200. After shuffling is completed, the cards are stacked on the first card supporting bracket 200 to form a new card stack 500. After turning the machine body 100 by a predetermined angle around the first connecting portion 203 (a state shown in FIG. 8), the card chamber 110 is enabled to leave surroundings of the new card stack 500, thereby enabling the card stack 500 to be taken away from the first card supporting bracket 200 without interference by the machine body 100. After the card stack 500 is taken away, reverse turning of the machine body 100 completes resetting of the machine body 100, thereby enabling entry into a next shuffling operation. The above solution not only avoids interference by the machine body 100 when taking away the card stack 500, but also enables single-hand operation for turning the machine body 100 and grasping the card stack 500, and the operation is simple and convenient. A user can turn the machine body 100 with one hand, while grasping the card stack 500 with another hand, using two hands to improve card taking efficiency.

In the present embodiment, the first card supporting bracket 200 is a card supporting plate. Use of the card supporting plate provides advantages of small thickness and light weight.

Figure 7:
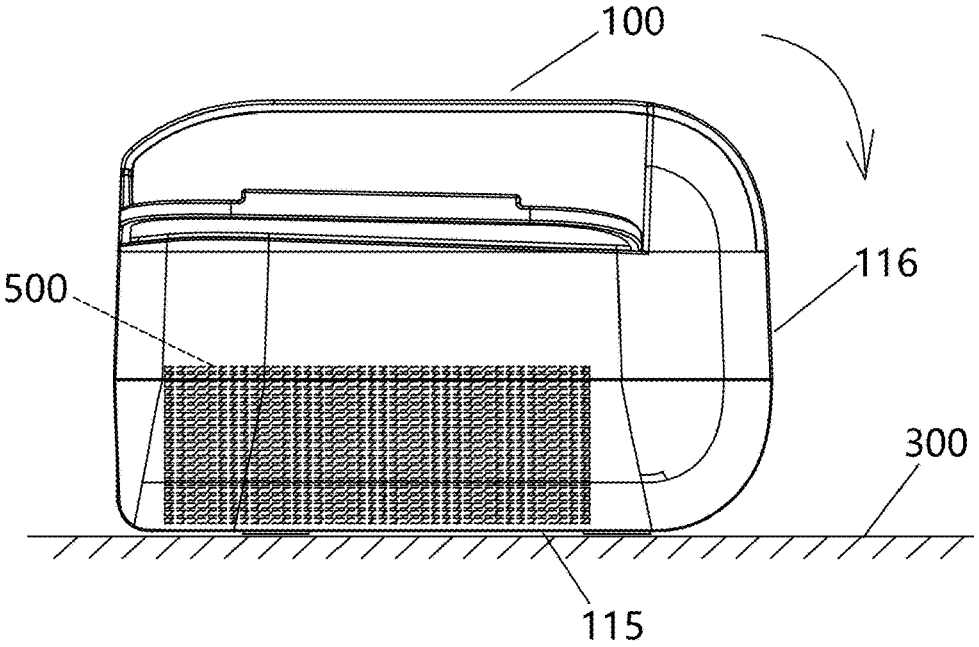
FIG. 7 is a schematic view of a shuffling state.
Figure 8:
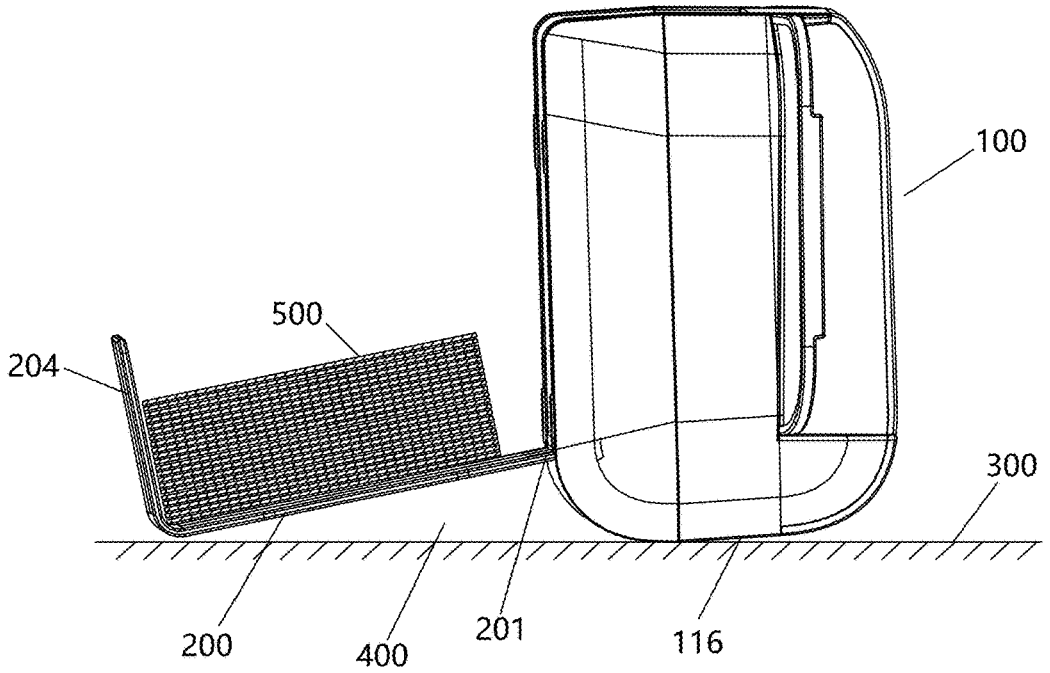
FIG. 8 is a schematic view of a card taking state.

In the above improved shuffling machine, the machine body 100 has two states: a shuffling state and a card taking state after shuffling is completed. FIG. 7 schematically shows the shuffling state, and FIG. 8 schematically shows the card taking state. In different states, different surfaces of the machine body 100 cooperate with a tabletop 300 to support the machine body 100 on the tabletop 300. For ease of distinction, in the card taking state, a surface of the machine body 100 cooperating with the tabletop 300 to support the machine body 100 is referred to as a first support surface 116, and in the shuffling state, a surface of the machine body 100 cooperating with the tabletop 300 to support the machine body 100 is referred to as a second support surface 115.

In the present embodiment, the front side surface 101 of the machine body 100 is the first support surface 116, and the bottom surface 109 of the machine body 100 is the second support surface 115.

In other embodiments, another side surface of the machine body 100 is selectable as the first support surface. For example, when the two card supply devices 103 are both disposed at the left side surface of the machine body 100, one side surface among the front side surface, the right side surface, and the rear side surface of the machine body 100 is selectable as the first support surface, and the first connecting portion 203 is arranged at an edge of the first card supporting bracket 200, and the edge is parallel to the first support surface and is closest to the first support surface.

After the first support surface is provided, cooperation of the first support surface with the tabletop enables support of the machine body 100 in the card taking state.

In some embodiments, the machine body 100 is also allowable to omit the first support surface. During card taking, one hand of the user maintains the machine body 100 in a turned state, another hand of the user takes away the card stack from the first card supporting bracket 200, and the machine body 100 is then reversely rotated to reset.

Figure 5:
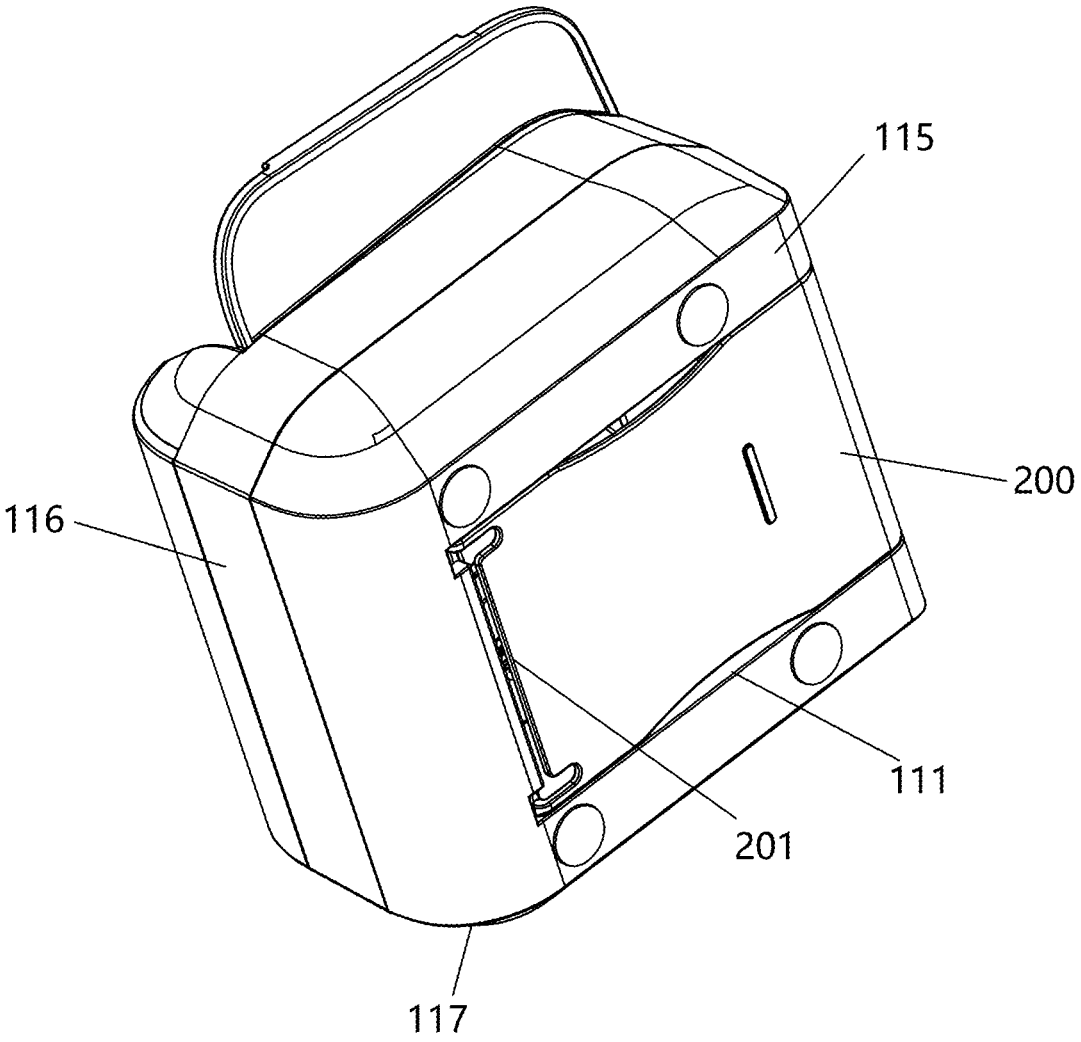
FIG. 5 is a schematic structural view of the shuffling machine from another viewing angle.
Figure 6:
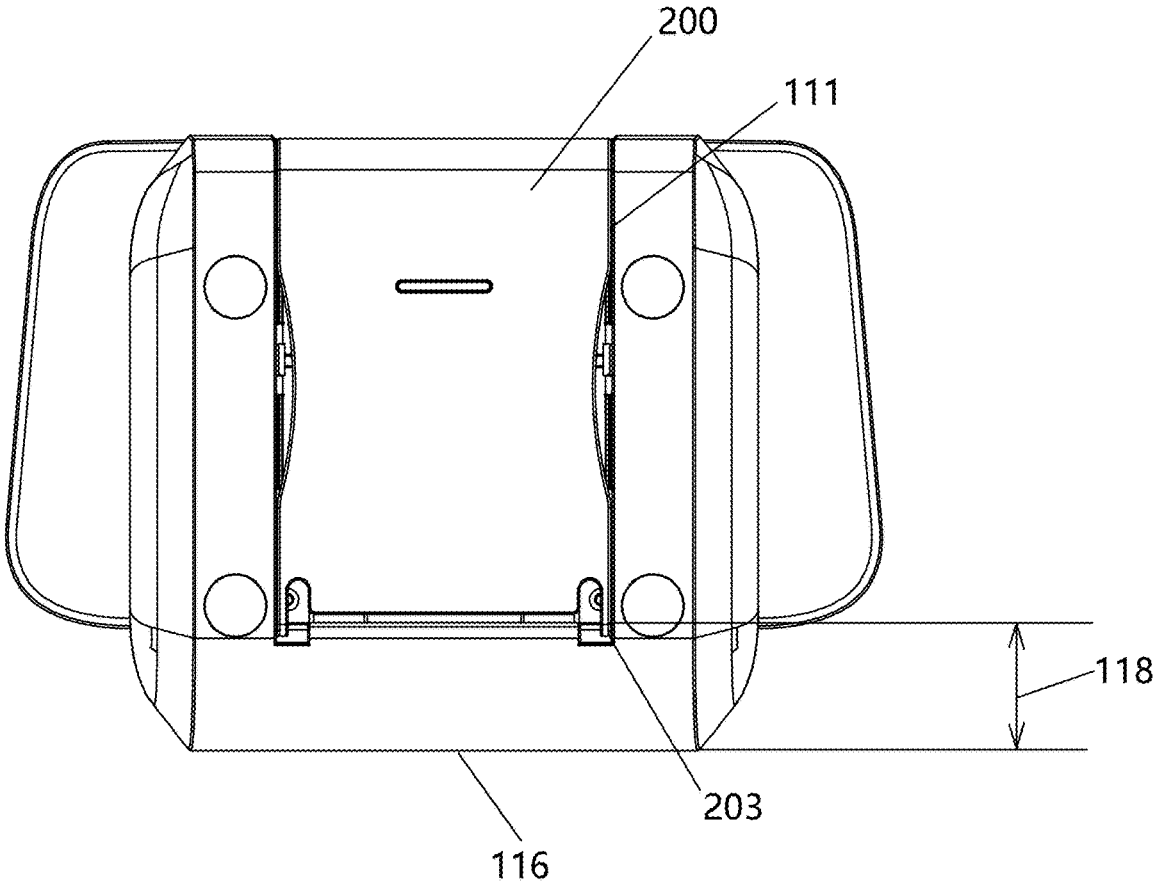
FIG. 6 is a schematic view of a preset distance between a first connecting portion and a first support surface.

In conjunction with FIG. 2, FIG. 5, and FIG. 6, a further improvement includes the first connecting portion 203 arranged at a first edge 201 of the first card supporting bracket 200, wherein the first edge 201 is parallel to the first support surface 116 and is closest to the first support surface 116. The first connecting portion 203 is spaced apart from the first support surface 116 by a preset distance 118.

Referring to FIG. 8, through the further improvement, after the machine body 100 enters the card taking state, the first edge 201 of the first card supporting bracket 200 is lifted upward, and a gap 400 is formed between the card stack 500 on the first card supporting bracket 200 and the tabletop 300. Accordingly, fingers of the user are insertable downward into the gap 400 from two opposite side surfaces of the card stack 500 on the first card supporting bracket 200, and the card stack 500 is graspable from a side portion and a bottom portion of the card stack 500, thereby enabling more reliable grasping of the card stack 500. In addition, an angle between the machine body 100 and the first card supporting bracket 200 in the card taking state is enabled to be greater than 90 degrees, and the card stack 500 is removable upward from the first card supporting bracket 200 without interference by the machine body 100.

The preset distance 118 is preferably not less than 10 millimeters and not greater than 50 millimeters. When the preset distance 118 is excessively large, the card stack 500 is prone to slide off the card supporting surface of the first card supporting bracket 200, namely, a card side-sliding phenomenon is prone to occur. When the preset distance 118 is excessively small, the gap 400 is excessively small, and the fingers of the user are not prone to be inserted into the bottom portion of the card stack 500.

Referring to FIG. 8, to avoid the above card side-sliding phenomenon, a further improvement includes a second edge opposite to the first edge 201 of the first card supporting bracket 200 provided with a card blocking portion 204 extending upward relative to the card supporting surface of the first card supporting bracket 200. As shown in FIG. 8, an upper surface of the first card supporting bracket 200 is the card supporting surface.

In the present embodiment, the card blocking portion 204 is a card blocking plate. The card blocking plate and the card supporting plate are integrally formed, and an overall structure is an L-shaped plate body. Use of the L-shaped plate body structure to form the first card supporting bracket 200 and the card blocking portion 204 provides advantages of simple structure and convenient manufacturing.

FIG. 7 shows the shuffling state. After rotating the machine body 100 by a predetermined angle around the first connecting portion 203 along a direction of an arrow in FIG. 7, entry into the card taking state is achieved. FIG. 8 shows the card taking state.

During a process of rotating the machine body 100 around the first connecting portion 203 to switch the machine body 100 from the shuffling state to the card taking state, a side portion of the card chamber 110 opposite to the first support surface 116 (a left side portion in FIG. 7) gradually approaches the card stack 500 on the first card supporting bracket 200. To avoid the side portion contacting the card stack 500, a feasible solution provides a clearance space reserved in the card chamber 110. Referring to FIG. 2, another feasible solution provides a clearance hole 114 at the side portion of the card chamber 110 opposite to the first support surface 116 of the machine body 100, and the clearance hole 114 is communicated with the card passing hole 111. Among the two solutions, the latter solution is beneficial for reducing a volume of the machine body 100.

After the clearance hole 114 is opened at the side portion of the card chamber 110, to avoid the cards falling out of the card chamber 110 from the clearance hole 114 during shuffling, a hole cover is disposable at the clearance hole 114. In the shuffling state, the hole cover closes the clearance hole 114.

A further improvement provides the card blocking portion 204 on the first card supporting bracket 200 configured as follows: in the shuffling state, the card blocking portion 204 extends to the side portion of the card chamber 110, and partially closes or completely closes the clearance hole 114. In the present embodiment, the card blocking portion 204 is the card blocking plate, and in the shuffling state, the card blocking plate extends to the side portion of the card chamber 110, and completely closes the clearance hole 114. The further improvement enables the card blocking portion 204 to have two functions as follows: in the shuffling state, the card blocking portion 204 has a function of the hole cover of the clearance hole 114, and in the card taking state, the card blocking portion 204 has a function of preventing card side-sliding. Accordingly, dedicated provision of a hole cover for the clearance hole 114 is unnecessary, and a machine body structure is simpler.

Referring to FIG. 5, a further improvement provides an arc-shaped guide surface 117 at a connecting portion between the second support surface 115 and the first support surface 116 of the machine body 100. During switching of the machine body 100 between the shuffling state and the card taking state, the arc-shaped guide surface 117 cooperates with the tabletop 300 to guide turning of the machine body 100, thereby making turning of the machine body 100 more stable.

In the present embodiment, the first connecting portion 203 of the first card supporting bracket 200 is specifically a shaft.

In conjunction with FIG. 2 to FIG. 5, a further improvement provides elastic lugs 202 at two ends of the first edge 201 of the first card supporting bracket 200, the elastic lugs 202 correspondingly extending away from the first card supporting bracket 200, and the first connecting portion 203 is connected to the elastic lug 202.

Correspondingly, an inner wall of the card passing hole 111 is provided with accommodating cavities 112 for the elastic lugs 202, and an inner wall of the accommodating cavity 112 is provided with a mounting hole 113 for the first connecting portion 203.

The further improvement enables the first connecting portion 203 to deform. Through deformation of the first connecting portion 203, the first connecting portion 203 is installed into the mounting hole 113, thereby enabling rotatable connection with the machine body 100. Accordingly, the first connecting portion 203 is enabled to adopt an integrated structure with the first card supporting bracket 200.

In the present embodiment, the elastic lugs 202, the first connecting portion 203, and the first card supporting bracket 200 are integrally formed by a plastic material, and the manufacturing is simple and the cost is low.

It should be noted that the first connecting portion of the first card supporting bracket 200 is also allowable to be a shaft hole, the shaft hole realizing rotatable connection between the machine body 100 and the first card supporting bracket 200 through cooperation with a shaft. The first connecting portion of the first card supporting bracket 200 is also allowable to be indirectly arranged at the first card supporting bracket 200. For example, a hinge rotatably connects the machine body 100 and the first card supporting bracket 200, and under the embodiment, a shaft of the hinge constitutes the first connecting portion of the first card supporting bracket 200.

Figure 9:
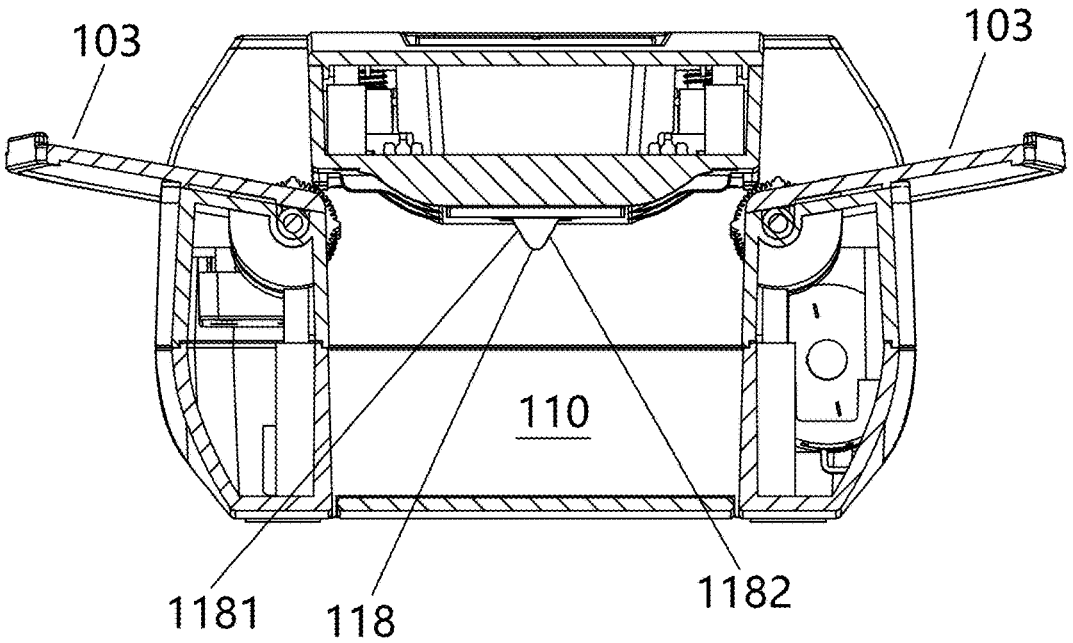
FIG. 9 is a schematic view of a guide portion at a top of a card chamber.

Referring to FIG. 9, in one embodiment, a top cover of the card chamber 110 is further provided with a card guide portion 118 facing toward the card chamber 110, and the card guide portion 118 functions to guide the cards to smoothly enter the card chamber. The card guide portion 118 is hinged to the top cover of the card chamber 110. The card guide portion 118 has a left guide inclined surface 1181 and a right guide inclined surface 1182. When the cards entering from the left card supply device 103 collide with the card guide portion 118, the card guide portion 118 swings rightward, and the cards fall into the card chamber 110 under guidance of the left guide inclined surface 1181. When the cards entering from the right card supply device 103 collide with the card guide portion 118, the card guide portion 118 swings leftward, and cards fall into the card chamber 110 under guidance of the right guide inclined surface 1182.

The present disclosure has been described in detail through specific embodiments. The detailed descriptions are limited to assisting persons skilled in the art to understand contents of the present disclosure and are not construed as limiting a protection scope of the present disclosure. Various modifications, equivalent transformations, and the like made by persons skilled in the art under a concept of the present disclosure shall be included within the protection scope of the present disclosure.

What is claimed is:

1. A shuffling machine, comprising:

a machine body, provided with a card chamber receiving cards from at least two card supply devices on the machine body, wherein the card chamber is provided with a card passing hole passing through a bottom of the card chamber; and a first card supporting bracket disposed at the card passing hole, wherein the first card supporting bracket is provided with at least one first connecting portion parallel to a card supporting surface of the first card supporting bracket, and the machine body is rotatably connected to the first connecting portion and is rotatable around the first connecting portion;

wherein the machine body includes a shuffling state and a card taking state after shuffling is completed, the machine body has a first support surface cooperating with a tabletop to support the machine body in the card taking state;

wherein the first card supporting bracket has a first edge, the first edge is parallel to the first support surface and is closer to the first support surface than remaining portions of the first card supporting bracket, the first connecting portion is arranged at the first edge, and the first connecting portion is spaced apart from the first support surface by a preset distance, configured such that when the machine body is rotated around the first connecting portion to switch from the shuffling state to the card taking state, the first edge is lifted upward by the machine body, and an angle is defined between the first card supporting bracket and the tabletop.

2. The shuffling machine according to claim 1, wherein the preset distance is not less than 10 millimeters and is not greater than 50 millimeters.

3. The shuffling machine according to claim 1, wherein the first card supporting bracket has a second edge opposite to the first edge, and the second edge is provided with a card blocking portion extending upward relative to the card supporting surface of the first card supporting bracket.

4. The shuffling machine according to claim 3, wherein a side portion of the card chamber opposite to the first support surface is provided with a clearance hole communicating with the card passing hole.

5. The shuffling machine according to claim 4, wherein, in the shuffling state, the card blocking portion extends to the side portion of the card chamber, and partially closes or completely closes the clearance hole.

6. The shuffling machine according to claim 5, wherein the first card supporting bracket is an L-shaped plate body.

7. The shuffling machine according to claim 1, wherein the machine body has a second support surface cooperating with the tabletop to support the machine body in the shuffling state, and a connecting portion between the second support surface and the first support surface is provided with an arc-shaped guide surface cooperating with the tabletop to guide rotation of the machine body.

8. The shuffling machine according to claim 1, wherein two ends of the first edge of the first card supporting bracket are respectively provided with elastic lugs extending away from the first card supporting bracket, and the first connecting portion is arranged at the elastic lug.

9. The shuffling machine according to claim 8, wherein the elastic lugs and the first connecting portions are integrally formed with the first card supporting bracket.

10. The shuffling machine according to claim 1, wherein a quantity of the card supply devices is two, the two card supply devices are disposed corresponding to a left side and a right side of the card chamber, the card chamber includes a top cover, the top cover is provided with a card guide portion facing toward the card chamber, the card guide portion is provided with a left guide inclined surface and a right guide inclined surface, the left guide inclined surface is configured to guide cards entering from the card supply device on the left side toward the bottom of the card chamber, the right guide inclined surface is configured to guide cards entering from the card supply device on the right side toward the bottom of the card chamber, and the card guide portion is hinged to the top cover and is swingable leftward and rightward.

* * * * *